US005926062A

United States Patent [19]

Kuroda

[11] Patent Number: 5,926,062

[45] Date of Patent: Jul. 20, 1999

[54] REFERENCE VOLTAGE GENERATING CIRCUIT

[75] Inventor: Hidehiko Kuroda, Tokyo, Japan

[73] Assignee: NEC Corporation, Tokyo, Japan

[21] Appl. No.: 09/102,835

[22] Filed: Jun. 23, 1998

[30] Foreign Application Priority Data

Jun. 23, 1997 [JP] Japan ..... 9-166331

[51] Int. Cl.[6] ..... G05F 3/16; G05F 1/10

[52] U.S. Cl. ..... 327/538; 327/513; 323/315

[58] Field of Search ..... 323/315, 316; 327/538, 539, 513

[56] References Cited

U.S. PATENT DOCUMENTS

| | | | |
|---|---|---|---|
| 5,430,395 | 7/1995 | Ichimaru | 327/312 |
| 5,594,382 | 1/1997 | Kato et al. | 327/541 |
| 5,619,163 | 4/1997 | Koo | 327/539 |
| 5,637,993 | 6/1997 | Whitney et al. | 323/315 |
| 5,644,269 | 7/1997 | Wong et al. | 330/261 |
| 5,783,936 | 7/1998 | Girard et al. | 323/315 |
| 5,815,012 | 9/1998 | Rivoir et al. | 327/103 |

FOREIGN PATENT DOCUMENTS

| | | |
|---|---|---|
| 58-97712 | 6/1983 | Japan . |
| 60-96006 | 5/1985 | Japan . |
| 63-234307 | 9/1988 | Japan . |
| 6-236956 | 8/1994 | Japan . |
| 7-201928 | 8/1995 | Japan . |

*Primary Examiner*—Kenneth B. Wells
*Assistant Examiner*—Maria Hasanzadah
*Attorney, Agent, or Firm*—Scully, Scott, Murphy & Presser

[57] ABSTRACT

A reference voltage generating circuit includes a constant current circuit, a current mirror circuit, and a load resistor. The constant current circuit generates a constant current proportional to a thermal electromotive force. The current mirror circuit uses the constant current generated by the constant current circuit as a reference current. The load resistor converts the output current of the current mirror circuit into a voltage. The current mirror circuit is constituted by a first transistor having a collector connected to the constant current circuit, a first resistor having one terminal connected to the emitter of the first transistor, a second transistor having a base connected to the base of the first transistor and a collector connected to the load resistor, a second resistor having one terminal connected to the emitter of the second transistor, a third transistor having a base connected to the collector of the first transistor and an emitter connected to the bases of the first and second transistors, and a third resistor connecting the base and emitter of the first transistor.

8 Claims, 6 Drawing Sheets

REFERENCE VOLTAGE GENERATING CIRCUIT

BACKGROUND OF THE INVENTION

The present invention relates to a reference voltage generating circuit, particularly, to a reference voltage generating circuit used in an integrated circuit and, more particularly, to a reference voltage generating circuit in which arbitrary temperature dependency can be obtained over a wide output voltage range.

As a reference voltage generating circuit for outputting a predetermined reference voltage, a Widlar bandgap reference voltage circuit like the one shown in FIG. 8 is known (P. R. GRAY & R. G. MEYER, Analysis and Design of Analog Integrated Circuits, Chapter 4).

As shown in FIG. 8, this reference voltage circuit comprises a Widlar current mirror circuit made up of transistors Q1 and Q2 and resistors R1, R2, and R3. The operating point of the reference voltage circuit is determined by a feedback loop so as to obtain an output voltage Vout equal to the sum of a base-emitter voltage VBE of a transistor Q3 and a voltage proportional to the difference between the base-emitter voltages of the two transistors Q1 and Q2.

In other words, the output voltage Vout can be regarded as the sum of the base-emitter voltage of the transistor Q3 and a voltage drop across the resistor R2. Since the collector current of Q2 is almost equal to the emitter current, the voltage drop across R2 is the product of a voltage drop across R3 and (R2/R3). The voltage drop across R3 is equal to the difference between the base-emitter voltages of Q1 and Q2.

The output voltage Vout and its temperature coefficient are therefore given by $$Vout = VBE(Q3) + \frac{R2}{R3} VT \cdot \ln(N) \tag{1}$$

$$\frac{\partial Vout}{\partial T} = \frac{\partial VBE(Q3)}{\partial T} + \frac{R2}{R3} \ln(N) \cdot \frac{\partial VT}{\partial T} \tag{2}$$

where N is the constant determined by an emitter area ratio of Q1 and Q2, VT is the thermal electromotive force, and VT=kT/q (k: Boltzmann's constant, T: absolute temperature, and q: electron charge).

In equation (2), $\partial VBE\ (Q3)/\partial T<0$, and $\partial VT/\partial T=k/q>0$ hold. Accordingly, in the Widlar bandgap reference voltage circuit, an arbitrary temperature coefficient including 0 can be realized by properly selecting R2, R3, and N.

In the Widlar bandgap reference voltage circuit, however, the range of Vout is as narrow as about 1.0 to 1.2 V because Vout is the sum of VBE (about 0.8 V) at Q3 and KVT (about 0.2 to 0.4 V).

To the contrary, for example, Japanese Patent Laid-Open No. 63-234307 (to be referred to as reference 1 hereinafter) discloses a bias circuit in which the output voltage Vout has an arbitrary temperature coefficient and which can output a voltage lower than the voltage of the Widlar bandgap reference voltage circuit.

As shown in FIG. 9, this bias circuit comprises a bandgap type constant current source 70 for outputting a current Is proportional to a thermal electromotive force VT, a current mirror circuit 80 made up of transistors Q1 and Q2 and resistors R1 and R2, a transistor Q3 which receives the current Is at the base, a transistor Q4 having a collector connected to the collector of the transistor Q2 of the current mirror circuit 80 and a base connected to the collector of the transistor Q3, a resistor R4 connected between the base and emitter of the transistor Q4, and a resistor R5 connected between the emitter and reference voltage of the transistor Q4. The output voltage is obtained by the collector terminal (Vout1) of the transistor Q3 or the emitter terminal (Vout2) of the transistor Q4.

The two output voltages Vout1 and Vout2 are given by $$Vout1 = \frac{R5}{RS1} VT \cdot \ln(N) + \left(1 + \frac{R5}{R4}\right) VF \tag{3}$$

$$Vout2 = \frac{R5}{RS1} VT \cdot \ln(N) + \frac{R5}{R4} VF$$

where N is the emitter area ratio of transistors QS1 and QS2, and VF is the base-emitter voltage of an NPN transistor.

The bias circuit in reference 1 comprises the two output voltage terminals Vout1 and Vout2. Vout1 outputs a voltage of VF or less, and Vout2 outputs a voltage of VF to 2VF. For this reason, a continuous voltage cannot be obtained by one terminal.

Partially differentiating right- and left-hand sides by the absolute temperature T yields $$\frac{\partial Vout1}{\partial T} = \frac{R5}{RS1} \frac{VT}{T} \cdot \ln(N) + \left(1 + \frac{R5}{R4}\right) \cdot \frac{\partial VF}{\partial T} \tag{4}$$

$$\frac{\partial Vout2}{\partial T} = \frac{R5}{RS1} \frac{VT}{T} \cdot \ln(N) + \frac{R5}{R4} \cdot \frac{\partial VF}{\partial T}$$

This means that adjusting the temperature coefficient of either one of Vout1 and Vout2 shifts the other temperature coefficient by $\partial VF/\partial T$. In the bias circuit in reference 1, therefore, the temperature coefficients of the two output voltages Vout1 and Vout2 cannot be made to coincide with each other.

Japanese Patent Laid-Open No. 58-97712 (to be referred to as reference 2 hereinafter) discloses a reference power supply circuit having an arbitrary temperature coefficient and a wide output voltage range.

As shown in FIG. 10, in the reference power supply circuit in reference 2, resistors R95 and R96 are respectively connected between the base and collector of a transistor Tr5 and between its base and emitter. The collector of the transistor Tr5 is connected to the base of a transistor Tr3. The emitter of the transistor Tr3 is connected to the emitter of the transistor Tr5 via a resistor R94. The emitter of the transistor Tr5 is also connected to a common terminal GND.

The collector of the transistor Tr5 receives a small current from the collector of a transistor Tr2 constituting a current mirror circuit 90.

The collector of the transistor Tr5 is further connected to the base of a transistor Tr4. The emitter of the transistor Tr4 is connected to the emitter of the transistor Tr5, and its collector is connected to Vcc via a resistor R93.

In the reference power supply circuit in reference 2, the base voltages of the transistors Tr3 and Tr4 are generated by a circuit (VBE multiplying circuit) made up of the resistors R95 and R96 and the transistor Tr5. Accordingly, an output voltage VX becomes unstable owing to variations in hFE of Tr5 caused by variations in manufacturing process or temperature.

In addition, the output voltage VX is influenced by variations in Vcc because it is equal to the difference between the external power supply voltage Vcc and the voltage across the resistor R93.

Japanese Patent Laid-Open No. 60-96006 (to be referred to as reference 3 hereinafter) discloses a reference voltage circuit capable of easily setting an arbitrary temperature coefficient and an arbitrary output voltage value.

As shown in FIG. 11, in this reference voltage circuit, the base voltages of transistors Q21 and Q22 are generated by resistors R21 and R22 connected to the emitter path of a transistor Q23. The collectors of the transistors Q21 and Q22 are connected to a current source by a current mirror circuit made up of transistors Q24 and Q25. The base of the transistor Q23 is connected to the collector of the transistor Q24. The emitter path of the transistor Q22 is connected to a resistor R23.

A reference voltage Vref is extracted from a resistor R24 connected to a power supply source formed from a transistor Q26 constituting the current mirror circuit together with the transistors Q24 and Q25.

The reference voltage circuit can arbitrarily set its temperature coefficient by adjusting the operating current density ratio of the transistors Q21 and Q22 and the ratio of the resistors R21 and R22. Further, this circuit can obtain an arbitrary reference voltage value by adjusting the ratio of the resistors R23 and R24.

The portion determining the reference voltage Vref serves as a frequency multiplier for the transistor Q22. For this reason, it is difficult to compensate for variations in base current caused by variations in hFE of the transistor Q22, similarly to the reference power supply circuit in reference 2.

As described above, in the prior art, no arbitrary temperature coefficient including 0 can be obtained in a wide range. Besides, the output voltage is influenced by variations in external power supply voltage Vcc.

SUMMARY OF THE INVENTION

It is an object of the present invention to provide a reference voltage circuit capable of setting an arbitrary temperature coefficient in a wide range and, more particularly, to provide a reference voltage generating circuit less dependent on the temperature with a temperature coefficient of zero.

It is another object of the present invention to provide a reference voltage generating circuit less dependent on variations in external power supply voltage Vcc.

In order to achieve the above objects, according to the present invention, there is provided a reference voltage generating circuit comprising a constant current circuit for generating a constant current proportional to a thermal electromotive force, a current mirror circuit using the constant current generated by the constant current circuit as a reference current, and a load resistor for converting an output current of the current mirror circuit into a voltage, the current mirror circuit comprising a first transistor having a collector connected to the constant current circuit, a first resistor having one terminal connected to an emitter of the first transistor, a second transistor having a base connected to a base of the first transistor and a collector connected to the load resistor, a second resistor having one terminal connected to an emitter of the second transistor, a third transistor having a base connected to a collector of the first transistor and an emitter connected to the bases of the first and second transistors, and a third resistor connecting the base and emitter of the first transistor.

DESCRIPTION OF THE PREFERRED EMBODIMENTS

Embodiments of the present invention will be described in detail below with reference to the accompanying drawings.

Figure 1:
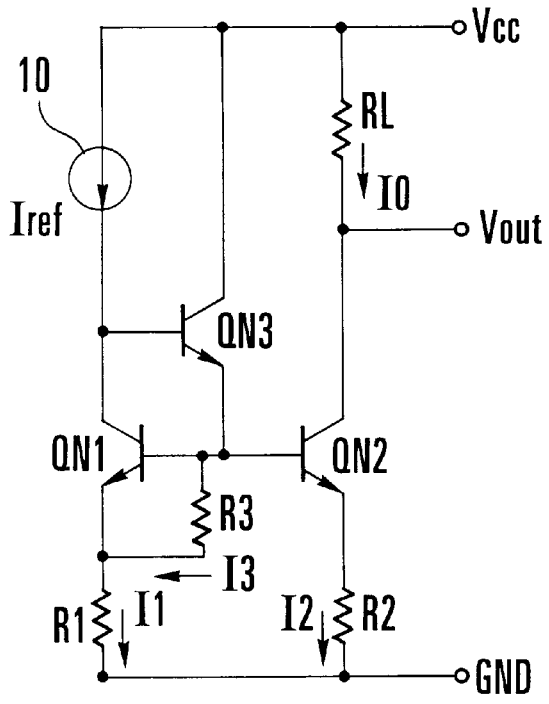
FIG. 1 is a circuit diagram for explaining a reference voltage generating circuit according to the first embodiment.
Figure 2:
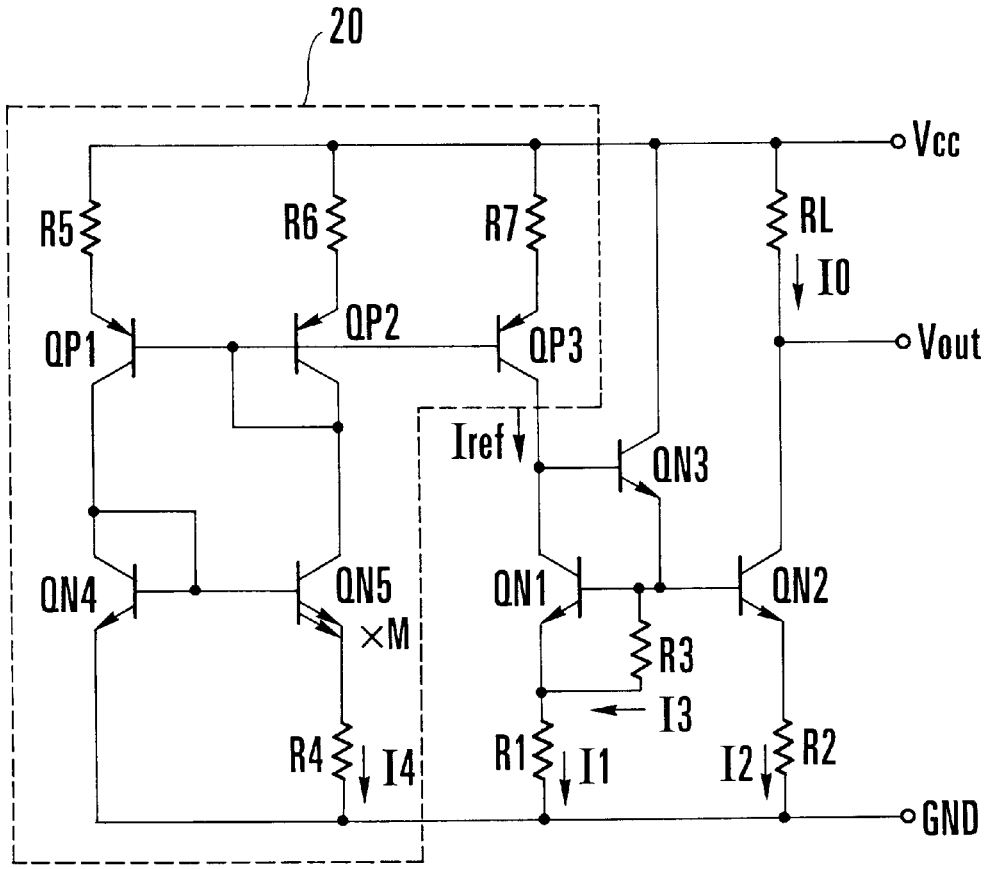
FIG. 2 is a circuit diagram for explaining the reference voltage generating circuit according to the first embodiment.
Figure 3:
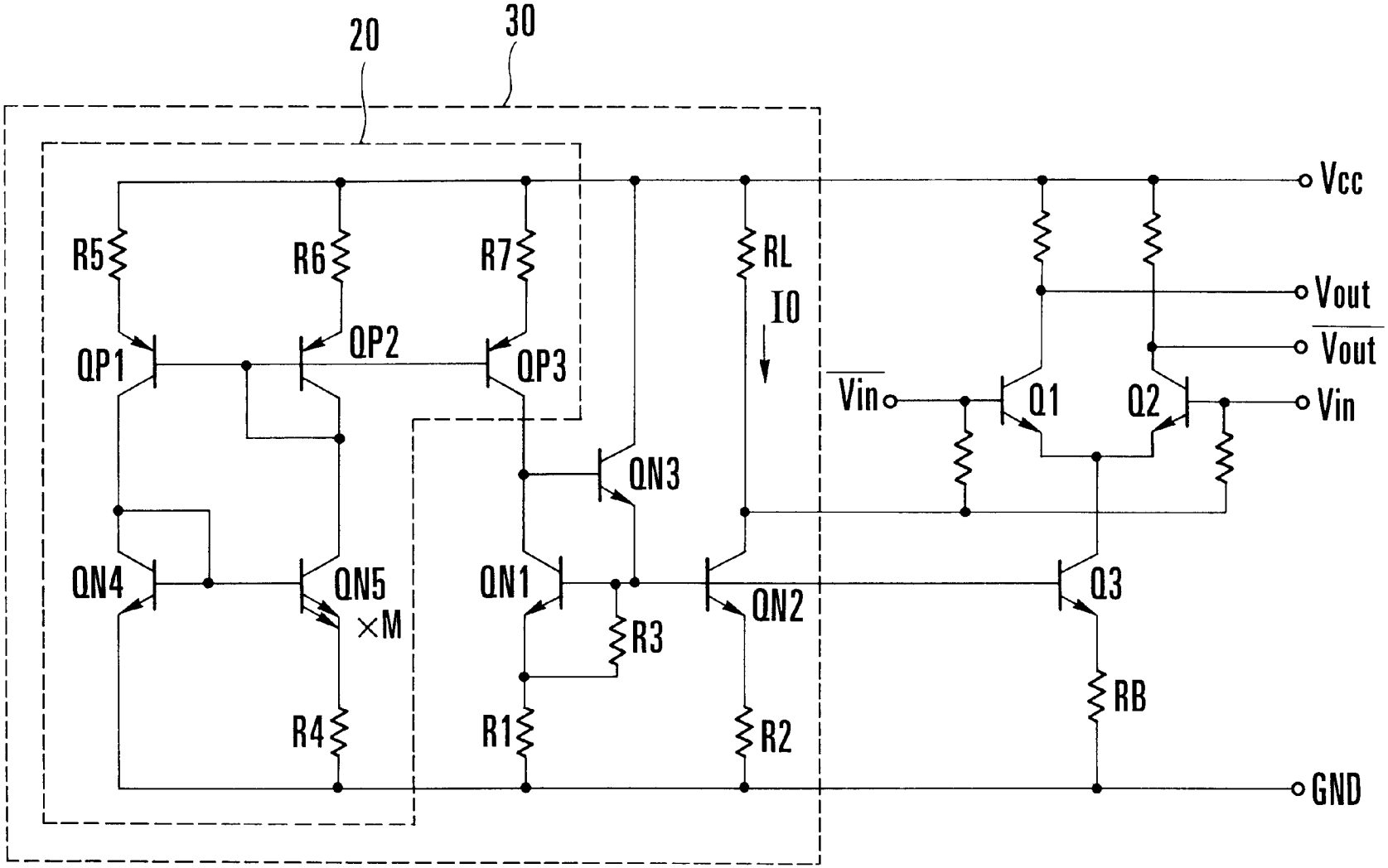
FIG. 3 is a circuit diagram for explaining a differential amplifying circuit as an application of the reference voltage generating circuit according to the first embodiment.

FIGS. 1, 2, and 3 show the first embodiment of the present invention. FIGS. 1 and 2 show a reference voltage generating circuit according to the first embodiment. FIG. 3 shows an operating circuit using the reference voltage generating circuit according to the first embodiment.

Referring to FIG. 1, a constant current source 10 generates a constant current Iref proportional to a thermal electromotive force. A current mirror circuit using the constant current Iref as a reference is constituted by a first transistor QN1 having a collector connected to the constant current source 10, a first resistor R1 having one terminal connected to the emitter of QN1, a second transistor QN2 having a base connected to the base of QN1, a second resistor R2 having one terminal connected to the emitter of QN2, a third transistor QN3 having a base connected to the collector of QN1, an emitter connected to the bases of QN1 and QN2, and a collector connected to an external power supply terminal, and a third resistor R3 for connecting the base and emitter of QN1.

A load resistor RL series-connected to the collector of QN2 of the current mirror circuit converts the collector current of QN2, i.e., an output current I0 of the current mirror circuit into a voltage.

Letting Vcc be an external power supply voltage, an output reference voltage Vout of the reference voltage generating circuit is given by $$Vout=Vcc-I0\cdot RL \tag{5}$$

The load resistor RL generally has temperature dependency (temperature coefficient). For example, a polysilicon resistor has a temperature coefficient of about −2,000 ppm/°C., and a diffused resistor has a temperature coefficient of about +2,000 ppm/°C.

In the reference voltage generating circuit according to the first embodiment, the output current I0 can have an arbitrary temperature change (temperature coefficient), and the output reference voltage Vcc can have an arbitrary temperature coefficient.

This arrangement will be explained in more detail by exemplifying the reference voltage generating circuit (FIG. 2) including a Widlar constant current circuit like the one shown in FIG. 2.

In FIG. 2, a constant current circuit 20 is constituted by a Widlar constant current circuit made up of a fourth transistor QN4 having an emitter grounded and a collector and base connected to each other, and a fifth transistor QN5 having a base connected to the base of QN4, an emitter grounded via a resistor R4, and an emitter area (emitter area ratio: M) different from that of QN4, and a constant current circuit made up of a sixth transistor QP1 having a collector connected to the collector of QN4, and a seventh transistor QP2 having a collector connected to the collector of QN5, a base connected to the base of QP1, the collector and base connected to each other, and the same emitter area as that of QP1. The constant current circuit 20 constitutes a self-bias feedback circuit.

The constant current circuit 20 keeps the collector currents of QN4 and QN5 at the same predetermined value by the constant current circuit made up of QP1 and QP2 having the same emitter area, and converts, into the output current Iref, a potential difference ΔVBE between the junction potentials of the transistors QN4 and QN5 which operate at different current densities owing to different emitter areas.

Since the transistors QN4 and QN5 have an emitter area ratio of 1:M, ΔVBE is given by ΔVBE=VT ln(M). Consequently, the output current of the constant current circuit, i.e., the reference current Iref of the reference voltage generating circuit is proportional to the thermal electromotive force VT and written as $$Iref = I4 = \frac{\Delta VBE}{R4} = \frac{\ln(M)}{R4} \cdot VT \tag{6}$$

The output current Iref is extracted from the collector of a transistor QP3 having a base connected to the base of QP2 and the same emitter area as that of QP2, and serves as the reference current Iref of the current mirror circuit made up of QN1 and QN2.

The reference voltage circuit constituted by the constant current circuit 20 and the current mirror circuit operates as follows.

Assume that the first and second transistors QN1 and QN2 of the current mirror circuit have an Early voltage VA much higher than a collector-emitter voltage VCE, and a current amplification factor hFE much larger than 1.

Ignoring the base currents of QN1 and QN2, base voltages VB (QN1) and VB (QN2) are equal to each other and given by $$\begin{aligned} VB(QN1) = VB(QN2) &= R3I3 + R1I1 = R3I3 + R1(Iref + I3) \\ &= R3\frac{VBE(QN1)}{R3} + R1\left(Iref + \frac{VBE(QN1)}{R3}\right) \\ &= VBE(QN1) + R1\left(Iref + \frac{VBE(QN1)}{R3}\right) \end{aligned} \tag{7}$$

where VBE (QN1) is the base-emitter voltage of the transistor QN1.

The current I0 flowing through the load resistor RL is equal to a current I2 flowing through the resistor R2 connected to the emitter of QN2 and is given by $$\begin{aligned} I0 = I2 &= \frac{VB(QN2) - VBE(QN2)}{R2} \\ &= \frac{VBE(QN1) + R1\left(Iref + \frac{VBE(QN1)}{R3}\right) - VBE(QN2)}{R2} \\ &= \frac{\left(1 + \frac{R1}{R3}\right)VBE(QN1) - VBE(QN2) + R1 \cdot Iref}{R2} \end{aligned} \tag{8}$$

Accordingly, the output reference voltage of the reference voltage generating circuit is written as $$\begin{aligned} Vout &= Vcc - RL \cdot I0 \\ &= Vcc - \frac{RL}{R2}\left\{\left(1 + \frac{R1}{R3}\right)VBE(QN1) - VBE(QN2) + R1 \cdot Iref\right\} \end{aligned} \tag{9}$$

Substituting equation (6) into Iref in equation (9) yields the output voltage Vout given by $$Vout = Vcc - \frac{RL}{R2}\left\{\left(1 + \frac{R1}{R3}\right)VBE(QN1) - VBE(QN2) + \frac{R1}{R4}\ln(M) \cdot VT\right\} \tag{10}$$

Partially differentiating equation (10) with the temperature T, the temperature coefficient of the output reference voltage Vout is written as $$\frac{\partial Vout}{\partial T} = -\frac{RL}{R2}\left\{\left(1 + \frac{R1}{R3}\right)\frac{\partial VBE(QN1)}{\partial T} - \frac{\partial VBE(QN2)}{\partial T} + \frac{R1}{R4}\ln(M) \cdot \frac{\partial VT}{\partial T}\right\} \tag{11}$$

VBE (QN1)/∂T=∂VBE (QN2)/∂T=∂VBE/∂T is established. In general, ∂VBE/∂T<0 (∂VBE/∂T=−2 mV/°C.), or ∂VT/∂T>0 (∂VT/∂T=k/q=87 μV/°C.) is satisfied. Equation (11) can be rewritten as $$\frac{\partial Vout}{\partial T} = -\frac{RL}{R2}\left\{\frac{R1}{R3}(-2 \times 10^{-3}) + \frac{R1}{R4}\ln(M) \times (87 \times 10^{-5})\right\} \tag{12}$$

Equation (12) represents that the temperature coefficient of the reference voltage generating circuit can be arbitrarily set to be positive or negative by the 4 ratios of R1/R3 and R1/R4.

Particularly, the resistors R1 to R4 and RL are made to have the same temperature coefficient sign by using the same type of resistors for them. By arbitrarily selecting their resistance values, the content in { } in equation (12) can be made zero. As a result, a reference voltage generating circuit independent of the temperature can be obtained.

The potential of the output reference voltage Vout can be changed by the value of the load resistor RL within the range of VCE(SAT) (QN2) to the external power supply voltage Vcc. Note that VCE(SAT) (QN2) is the collector-emitter saturation voltage of the second transistor QN2.

For simplicity, assuming VBE (QN1)=VBE (QN2)=VBE, R3=NR2, and R2=R, equations (10), (11), and (12) can be respectively rewritten as equations (13), (14), and (15):

$$Vout = Vcc - \frac{RL}{R}\left\{\left(1+\frac{R1}{NR}\right)VBE - VBE + \frac{R1}{R4}\ln(M)\cdot VT\right\} \quad (13)$$
$$= Vcc - \frac{RLR1}{NR^2}\left(V_{BE} + \frac{NR}{R4}\ln(M)\cdot VT\right)$$

$$\frac{\partial Vout}{\partial T} = -\frac{RLR1}{NR^2}\left(\frac{\partial VBE}{\partial T} + \frac{NR}{R4}\ln(M)\cdot\frac{\partial VT}{\partial T}\right) \quad (14)$$

$$\frac{\partial Vout}{\partial T} = -\frac{RLR2}{NR^2}\left\{(-2\times10^{-3}) + \frac{NR}{R4}\ln(M)\times(87\times10^{-6})\right\} \quad (15)$$

The reference voltage generating circuit independent of the temperature can be used as a bias circuit at the input terminal of, e.g., a mixing circuit or differential circuit.

For example, FIG. 3 shows a differential circuit using the reference voltage generating circuit shown in FIG. 2 as a bias circuit.

A reference voltage generating circuit 30 comprises the constant current circuit 20 shown in FIG. 2. A differential amplifier is constituted by two NPN transistors Q1 and Q2.

The base of a transistor Q3, which has a collector connected to the emitters of the two NPN transistors Q1 and Q2 of the differential amplifier, constitutes a current mirror circuit together with the bases of the transistors QN1 and QN2 of the reference voltage generating circuit. The transistor Q3 functions as the constant current source of the differential amplifier.

A gain GV of the differential amplifier is given by the load resistor RL of the reference voltage generating circuit 30, the current 10 flowing through RL, and the thermal electromotive force VT as $$GV = \frac{RL\cdot I0}{2VT} \quad (16)$$

Note that the transistor Q3, and the second transistor QN2 of the reference voltage generating circuit 30 have an emitter area ratio of 1:1. A resistor RB series-connected to the emitter of Q3 has the same value of the resistor R2 series-connected to Q2.

Figure 4:
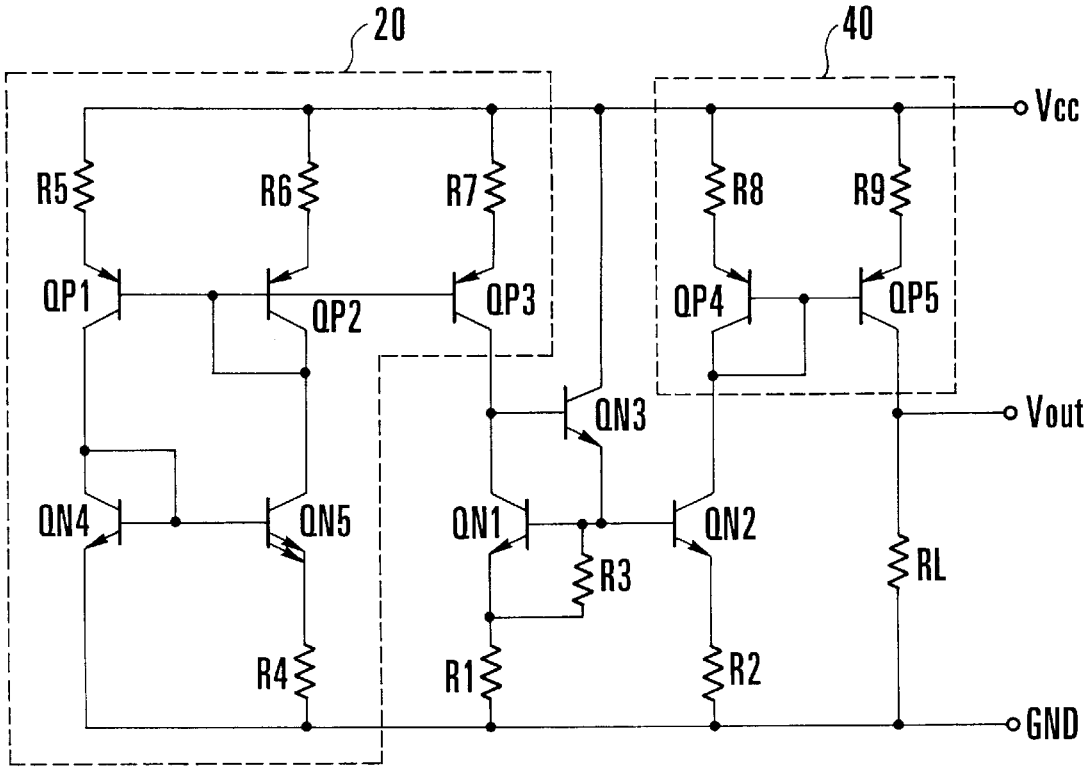
FIG. 4 is a circuit diagram for explaining a reference voltage generating circuit according to the second embodiment.

The second embodiment of the present invention will be described with reference to FIG. 4.

In a reference voltage generating circuit according to the second embodiment, a second current mirror circuit 40 made up of PNP transistors QP4 and QP5 is connected instead of the load resistor RL (see FIGS. 1 and 2) of the reference voltage generating circuit according to the first embodiment. The collector current of an NPN transistor QN2 is flowed back at 1:1 and extracted as the collector current of QP5. A load resistor RL is inserted between the collector and GND.

In this case, the two PNP transistors QP4 and QP5 have the same emitter area (emitter area ratio of 1:1). Two resistors R8 and R9 respectively series-connected to the emitters of the transistors QP4 and QP5 have the same value.

Note that a constant current circuit 20 has the same arrangement as that in the reference voltage generating circuit according to the first embodiment.

The output voltage Vout of this reference voltage generating circuit is given by $$Vout = \frac{RL}{R2}\left\{\left(1+\frac{R1}{R3}\right)VBE(QN1) - VBE(QN2) + \frac{R1}{R4}\ln(M)\cdot VT\right\} \quad (17)$$

Compared equation (17) with equation (10), in the reference voltage generating circuit according to the second embodiment, the output reference voltage Vout independent of the external power supply voltage Vcc can be obtained using the second current mirror circuit 40.

The temperature coefficient is given by $$\frac{\partial Vout}{\partial T} = \frac{RL}{R2}\left\{\left(1+\frac{R1}{R3}\right)\frac{\partial VBE(QN1)}{\partial T} - \frac{\partial VBE(QN2)}{\partial T} + \frac{R1}{R4}\ln(M)\cdot\frac{\partial VT}{\partial T}\right\} \quad (18)$$

Similar to the reference voltage generating circuit according to the first embodiment, equation (18) represents that the temperature coefficient of the reference voltage generating circuit can be arbitrarily set to be positive or negative by the ratios of R1/R3 and R1/R4.

Particularly, the resistors R1 to R4 and RL are made to have the same temperature coefficient sign by using the same type of resistors for them. By arbitrarily selecting their resistance values so as to zero the content in { } in equation (12), a reference voltage generating circuit independent of the temperature can be obtained.

The potential of the output reference voltage Vout can be changed by the value of the load resistor RL within the range of GND (0 V) to Vcc−VCE(SAT) (QP5). Note that VCE (SAT) (QP5) is the collector-emitter saturation voltage of the PNP transistor QP5 of the second current mirror circuit.

Note that in the second embodiment, the transistor QP4 of the second current mirror circuit 40 has diode connection in which the collector and base are directly connected to each other.

The collector and base of QP4 can be directly connected in this manner, but may be connected via a base current compensating transistor, as a matter of course.

By connecting the collector and base via the base current compensating transistor, the base current can be compensated to reduce errors even when hFE is small between the first and second PNP transistors QP4 and QP5 constituting the second current mirror circuit 40.

The third embodiment of the present invention will be described with reference to FIG. 5.

In a reference voltage generating circuit according to the third embodiment, the output reference voltage Vout is independent of the external power supply voltage Vcc, similar to the second embodiment described above.

Similar to the first embodiment, the reference voltage generating circuit is constituted by a constant current circuit 50 for generating a constant current proportional to a thermal electromotive force, a current mirror circuit using the constant current Iref as a reference current, and a load resistor RL for converting the output current of the current mirror circuit into a voltage. Note that the current mirror circuit is made up of NPN transistors (see FIGS. 1 and 2) in the first embodiment, whereas it is made up of PNP transistors in the third embodiment, as shown in FIG. 5.

More specifically, in the reference voltage generating circuit according to the third embodiment, the current mirror circuit is made up of PNP transistors QP1, QP2, and QP3. The collector of the first PNP transistor QP1 is connected to the output terminal of the constant current circuit 50, and its emitter is connected to the external power supply Vcc via a first resistor R1. The emitter of the second PNP transistor QP2 is connected to the external power supply Vcc via a second resistor R2, and its collector is grounded via the load resistor RL. The bases of the two transistors QP1 and QP2 are connected to each other. The base and emitter of QP1 are connected via a third resistor R3.

The third PNP transistor QP3 having a base connected to the collector of QP1 and an emitter connected to the bases of QP1 and QP2 serves as a base current compensating transistor.

The constant current circuit 50 is a self-bias feedback circuit constituted by a Widlar constant current circuit comprising two NPN transistors QN1 and QN2 and a resistor R4, and a constant current circuit comprising two PNP transistors QP4 and QP5. The basic operation of the self-bias feedback circuit is the same as the constant current circuit 20 described in the first embodiment.

The NPN transistor QN3 for supplying the reference current Iref to the current mirror circuit made up of QP1, QP2, and QP3 has a base connected to the bases of QN1 and QN2 constituting the Widlar constant current circuit. The collector currents of QN2 and QN3 are equalized by setting the emitter area of QN3 to 1:1 with respect to QN2 (1:M with respect to QN1), and setting R4=R7.

The above reference voltage generating circuit operates as follows.

Note that each transistor satisfies VA>>VCE and hFE>>1, and its base current can be ignored. QN1 and QN2 have an emitter area ratio of 1:M.

Base voltages VB (QP1) and VB (QP2) of the first and second PNP transistors QP1 and QP2 are given by $$\begin{aligned} VB(QP1) = VB(QP2) &= Vcc - (R1I1 + R3I3) \\ &= VCC - \{R1(Iref + I3) + R3I3\} \\ &= Vcc - \left\{R1\left(Iref + \frac{VBE(QP1)}{R3}\right) + R3\frac{VBE(QP1)}{R3}\right\} \\ &= Vcc - \left\{R1\left(1 + \frac{R1}{R3}\right)VBE(QP1) + Iref \cdot R1\right\} \end{aligned} \tag{19}$$

The output current I0 flowing through the load resistor RL is given by $$\begin{aligned} I0 = I2 &= \frac{Vcc - (VB(QP2) - VBE(QP2))}{R2} \\ &= \frac{Vcc - Vcc + \left\{\left(1 + \frac{R2}{R3}\right)VBE(QP1) + Iref \cdot R1\right\} - VBE(QP2)}{R2} \\ &= \frac{\left(1 + \frac{R1}{R3}\right)VBE(QP1) - VBE(QP2) + R1 \cdot Iref}{R2} \end{aligned} \tag{20}$$

The output current of the constant current circuit 50, i.e., the collector current Iref of the first PNP transistor QP1 is written as $$Iref = I4 = I7 = \frac{VT}{R4}\ln(M) \tag{21}$$

Figure 5:
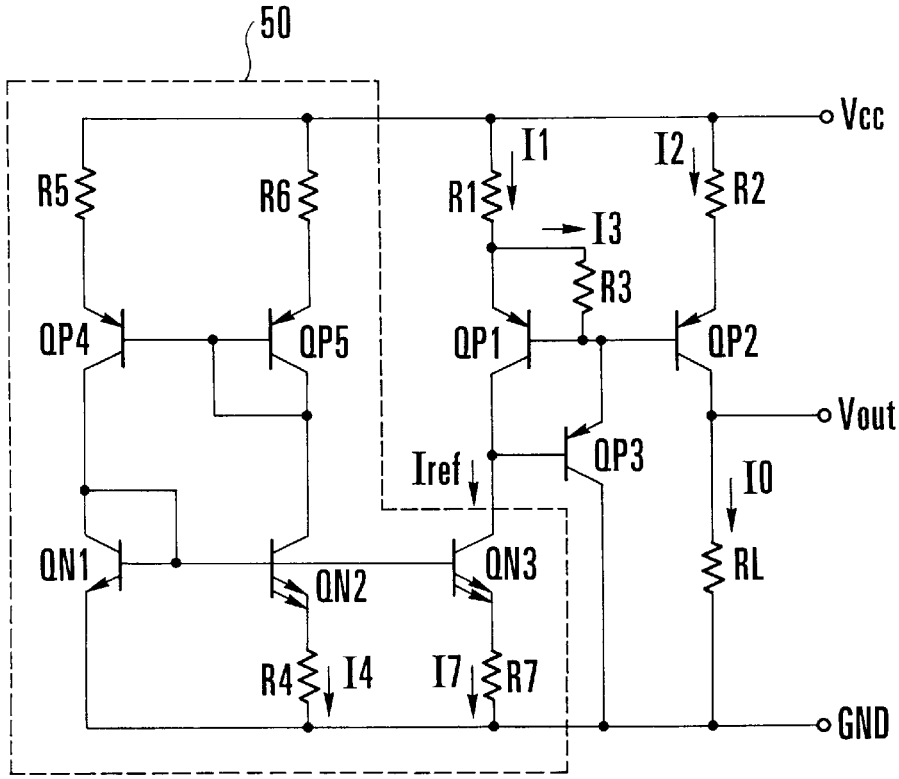
FIG. 5 is a circuit diagram for explaining a reference voltage generating circuit according to the third embodiment.

Therefore, the output reference voltage Vout of the reference voltage generating circuit shown in FIG. 5 is given by $$\begin{aligned} Vout &= I0 \cdot RL \\ &= \frac{RL}{R2}\left\{\left(1 + \frac{R1}{R3}\right)VBE(QP1) - VBE(QP2) + \frac{R1}{R4}\ln(M)\right\} \end{aligned} \tag{22}$$

Equation (22) is identical to equation (17) derived in the first embodiment.

Similar to equation (18), the temperature coefficient is given by $$\frac{\partial Vout}{\partial T} = \frac{RL}{R2}\left\{\left(1 + \frac{R1}{R3}\right)\frac{\partial VBE(QP1)}{\partial T} - \frac{\partial VBE(QP2)}{\partial T} + \frac{R1}{R4}\ln(M) \cdot \frac{\partial VT}{\partial T}\right\} \tag{23}$$

The temperature coefficient of the reference voltage generating circuit according to the third embodiment can be arbitrarily set by properly selecting the resistors R1 to R4.

The output reference voltage Vout is independent of variations in external power supply voltage Vcc and ranges from 0 to Vcc−VCE(SAT) (QP2). Note that VCE(SAT) (QP2) is the collector-emitter saturation voltage of the second PNP transistor QP2 having a collector connected to the load resistor RL.

A reference voltage generating circuit according to the fourth embodiment of the present invention will be described with reference to FIG. 6.

The reference voltage generating circuit according to the fourth embodiment is prepared such that the collector and base of QN4 are respectively connected to those of QP2 via a base current compensating transistor in a constant current circuit 60 made up of PNP transistors QP1, QP2, and QP3 and NPN transistors QN4 and QN5.

The constant current circuit 60 serving as a self-bias feedback circuit can be constituted by diode-connecting QN4 in a Widlar constant current circuit made up of QN4 and QN5 and a resistor R4, similar to the above-described embodiments.

If, however, the transistors constituting the constant current circuit 60 does not have a current amplification factor hFE much larger than 1, the current flowing from the collector of QN4 to the bases of QN4 and QN5 cannot be negligible and causes errors.

Also in the constant current circuit made up of QP1, QP2, and QP3, the collector and base of QP2 may be connected. However, when these transistors cannot obtain a sufficiently large current amplification factor hFE, the base current cannot be negligible and causes errors in the output current (collector current Iref of QP3). Particularly in a small-gain PNP transistor, such an error becomes conspicuous because no satisfactorily large hFE can be obtained.

Accordingly, in the reference voltage generating circuit according to the fourth embodiment, the collector and base of the NPN transistor QN4 constituting the constant current circuit 60 are respectively connected to the base and emitter of a first base current compensating transistor QN6 having a collector connected to the external power supply terminal.

In addition, the collector and base of the PNP transistor QP2 are respectively connected to the base and emitter of the second base current compensating transistor QP4 having a collector grounded.

In this way, the collectors and bases of QN4 and QP2 are respectively connected to the first and second base current compensating transistors QN6 and QP4. With this arrangement, even when no satisfactorily large hFE can be set for each transistor constituting the constant current circuit 60, the base current of the transistor is compensated to reduce an output current (Iref) error of the constant current circuit 60. As a result, variations in output current Iref of the constant current circuit can be suppressed against variations in hFE caused in the manufacturing process, and a high-precision output reference voltage Vout can be obtained in the reference voltage generating circuit.

Figure 6:
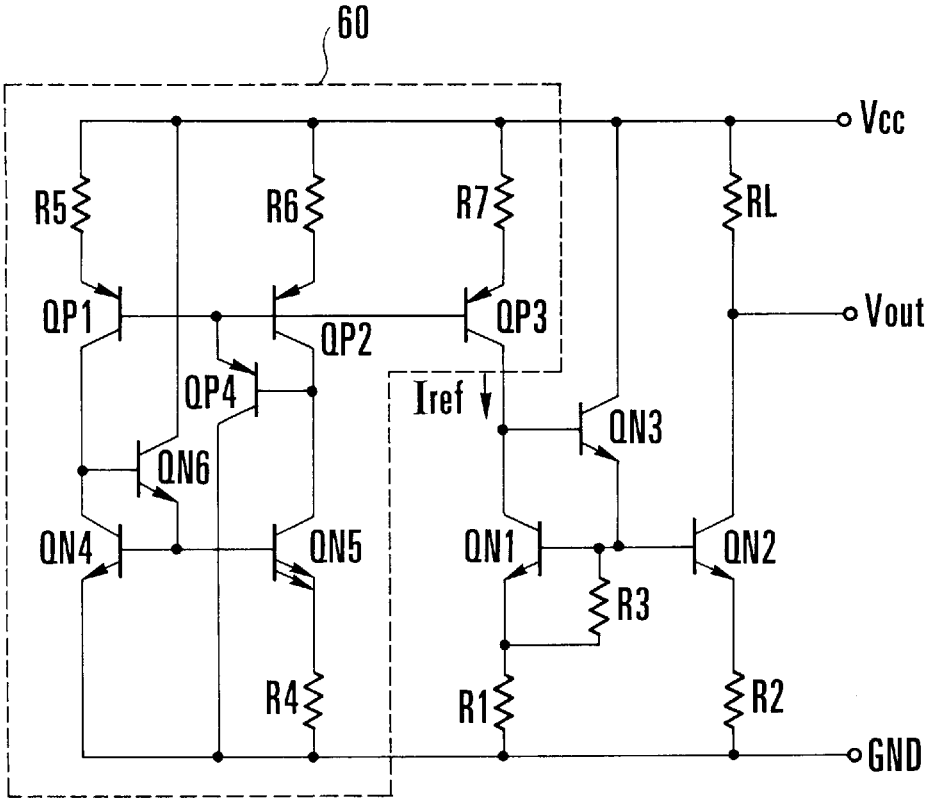
FIG. 6 is a circuit diagram for explaining a reference voltage generating circuit according to the fourth embodiment.
Figure 7:
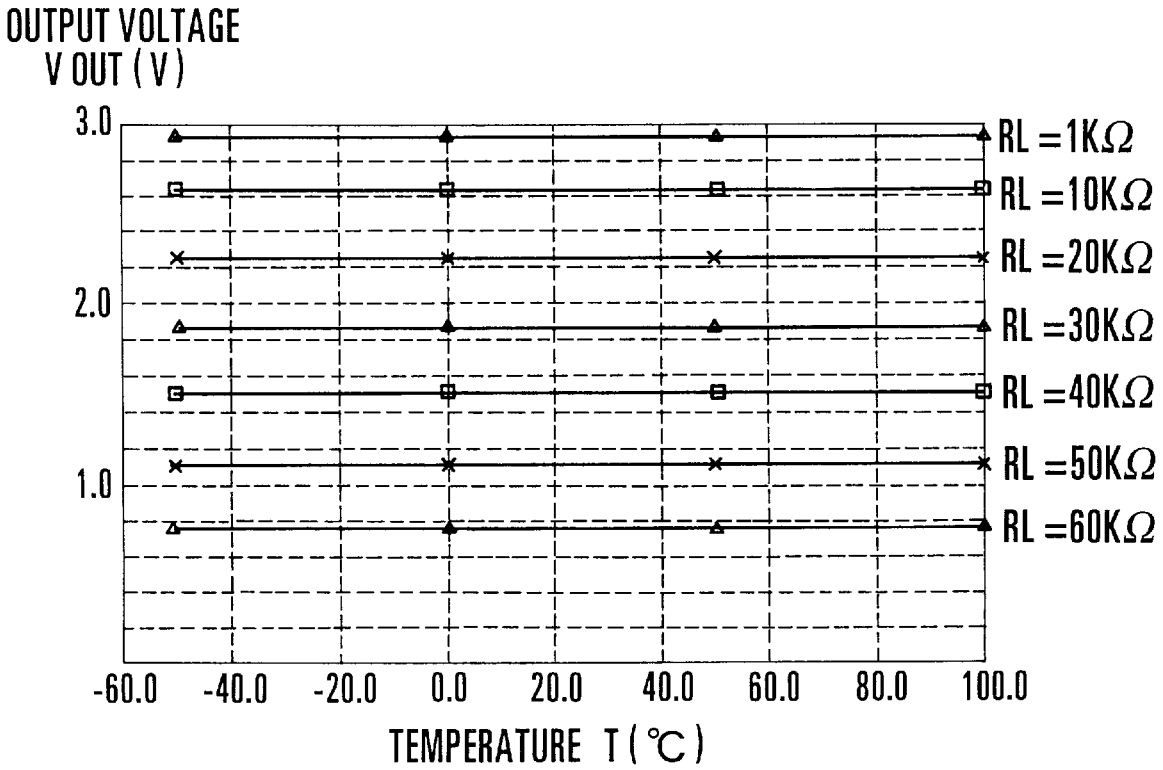
FIG. 7 is a graph showing the simulation results of the reference voltage generating circuit according to the fourth embodiment.
Figure 8:
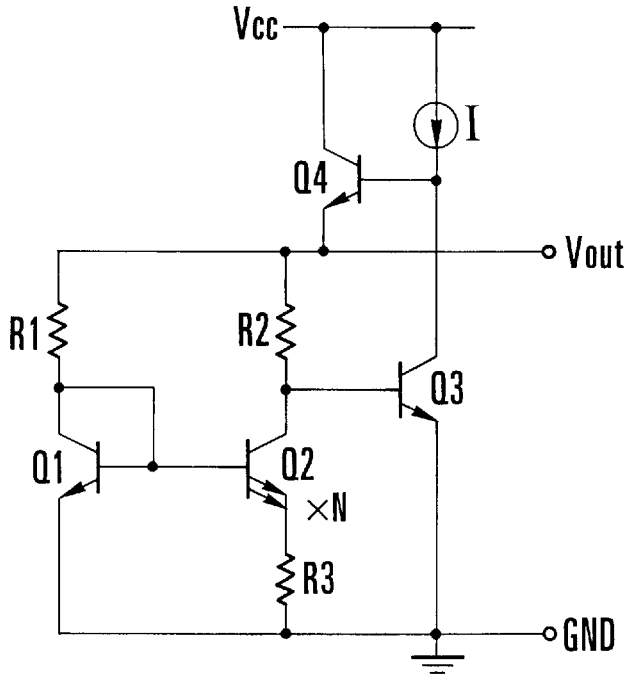
FIG. 8 is a circuit diagram for explaining a conventional Widlar bandgap reference voltage circuit.
Figure 9:
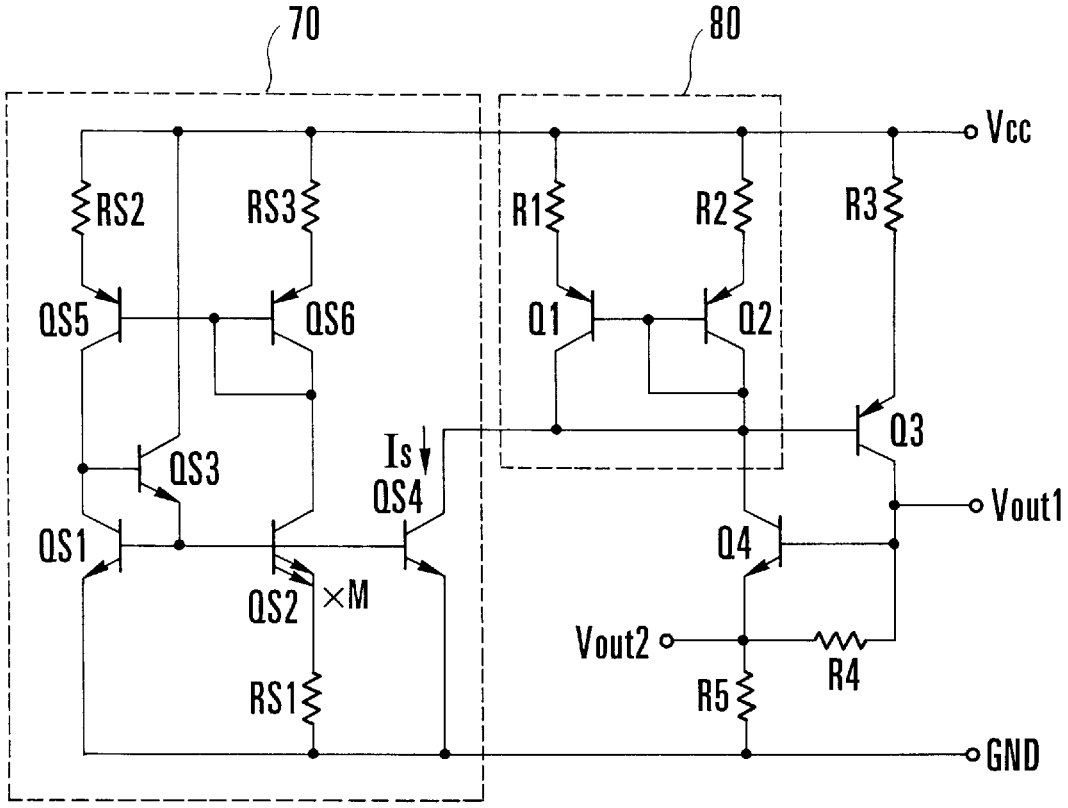
FIG. 9 is a circuit diagram for explaining the first prior art.
Figure 10:
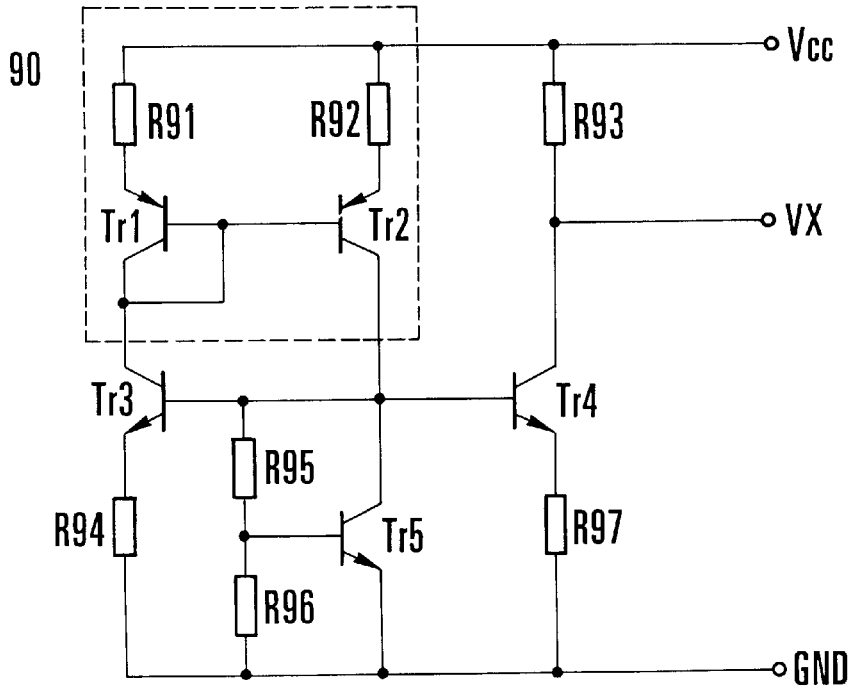
FIG. 10 is a circuit diagram for explaining the second prior art.
Figure 11:
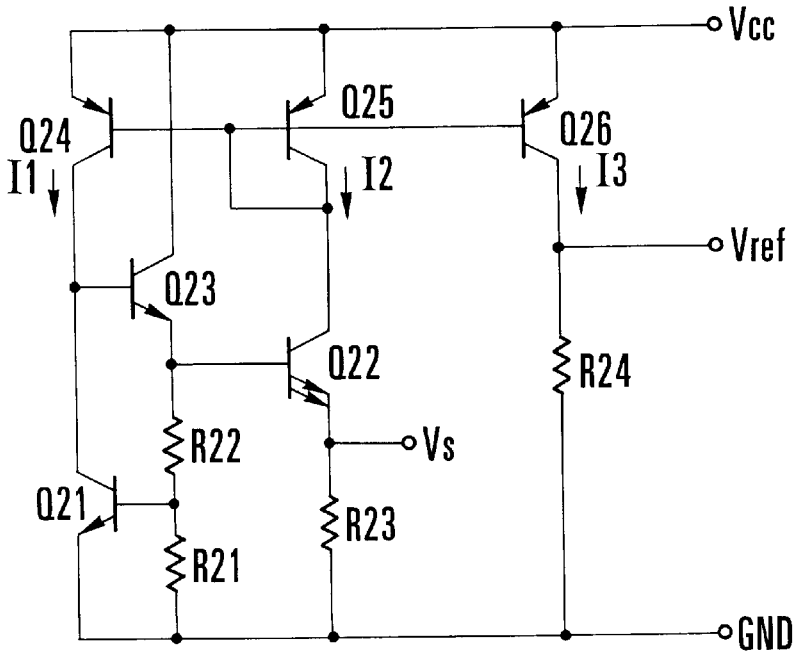
FIG. 11 is a circuit diagram for explaining the third prior art.

FIG. 7 shows the simulation results of the reference voltage generating circuit according to the fourth embodiment shown in FIG. 6. The abscissa represents the temperature, and the ordinate represents the output reference voltage. The output reference voltage Vout was calculated for seven different load resistors RL ranging from 1 kΩ to 60 kΩ at temperatures of −50° C., 0° C., 50° C., and 100° C.

This simulation was performed at an external power supply voltage Vcc=3 V, an emitter area ratio M=4, R1=400 Ω, R2=R3=3 kΩ, and R4=1 kΩ so as to make the temperature coefficient zero.

The simulation results reveal that the output reference voltage Vout can be obtained in a wide range of VCE(SAT) (QN2) (about 0.5 V) to Vcc=3 V by properly selecting the value of the load resistor RL.

The reference voltage generating circuit is found to be less dependent on the temperature at each output reference voltage.

According to the present invention, of the transistors constituting the current mirror circuit, the base and emitter of the first transistor are connected by the third resistor. This allows the current I0 flowing through the load resistor RL connected to the collector of the second transistor to have an arbitrary temperature coefficient. Since the load resistor RL generally has temperature dependency (temperature coefficient), an output reference voltage having an arbitrary temperature coefficient can be realized by allowing the current I0 to have an arbitrary temperature coefficient. In particular, if the temperature coefficient of the current I0 is set to cancel the temperature coefficient of the load resistor RL, a reference voltage generating circuit less dependent on the temperature can be obtained.

The output reference voltage obtained by the product of the load resistor RL and the current I0 flowing through the load resistor RL ranges from VCE(SAT) to Vcc or 0 to VCE(SAT). This voltage can be obtained from one terminal.

When the first, second, and third transistors are made of PNP transistors, and the collector of the second transistor is grounded via the load resistor, a reference voltage less dependent on variations in external power supply voltage Vcc can be generated.

The output current of the first current mirror circuit made up of NPN transistors is flowed back at the second current mirror circuit. This output reference voltage is extracted from the load resistor RL connected between GND and the collector of the second PNP transistor constituting the second current mirror circuit. With this arrangement, a reference voltage generating circuit less dependent on the external power supply voltage can be obtained.

The constant current circuit includes a Widlar constant current circuit, and a base current compensating transistor is arranged in a self-bias feedback circuit constituting a bandgap constant current circuit. With this arrangement, even when no satisfactorily large hFE can be set for each transistor constituting the constant current circuit, or hFE varies in the manufacturing process, variations in output current Iref of the constant current circuit can be suppressed. A high-precision reference voltage generating circuit can therefore be obtained.

What is claimed is:

1. A reference voltage generating circuit comprising:

a constant current circuit for generating a constant current proportional to a thermal electromotive force;

a current mirror circuit using the constant current generated by said constant current circuit as a reference current; and a load resistor for converting an output current of said current mirror circuit into a voltage, said current mirror circuit comprising a first transistor having a collector connected to said constant current circuit, a first resistor having one terminal connected to an emitter of said first transistor, a second transistor having a base connected to a base of said first transistor and a collector connected to said load resistor, a second resistor having one terminal connected to an emitter of said second transistor, a third transistor having a base connected to a collector of said first transistor and an emitter connected to said bases of said first and second transistors, and a third resistor connecting said base and emitter of said first transistor.

2. A circuit according to claim 1, wherein said first, second, and third transistors are NPN transistors, said emitters of said first and second transistors are respectively grounded via said first and second resistors, said collector of said second transistor is connected to an external power supply terminal via said load resistor, and a collector of said third transistor is connected to said external power supply terminal.

3. A circuit according to claim 1, wherein said first, second, and third transistors are PNP transistors, said emitters of said first and second transistors are respectively connected to an external power supply terminal via said first and second resistors, said collector of said second transistor is grounded via said load resistor, and a collector of said third transistor is grounded.

4. A reference voltage generating circuit comprising:

a constant current circuit for generating a constant current proportional to a thermal electromotive force;

a first current mirror circuit using the constant current generated by said constant current circuit as a reference current;

a second current mirror circuit using an output current of said first current mirror circuit as a reference current; and a load resistor for converting an output current of said second current mirror circuit into a voltage, said first current mirror circuit comprising a first NPN transistor having a collector connected to said constant current circuit, a first resistor having one terminal connected to an emitter of said first transistor and the other terminal grounded, a second NPN transistor having a base connected to a base of said first NPN transistor and a collector connected to said second current mirror circuit, a second resistor having one terminal connected to an emitter of said second NPN transistor and the other terminal grounded, a third NPN transistor having a base connected to a collector of said first NPN transistor and an emitter connected to said bases of said first and second NPN transistors, and a third resistor connecting said base and emitter of said first NPN transistor, and said second current mirror circuit comprising a first PNP transistor having a collector connected to said collector of said second NPN transistor of said first current mirror circuit and a base connected to said collector of said first PNP transistor, a fourth resistor having one terminal connected to an emitter of said first PNP transistor and the other terminal connected to an external power supply terminal, a second PNP transistor having a base connected to said base of said first PNP transistor and a collector grounded via said load resistor, and a fifth resistor having one terminal connected to an emitter of said second PNP transistor and the other terminal connected to said external power supply terminal.

5. A circuit according to claim 1, wherein said constant current circuit comprises a Widlar constant current circuit constituted by a fourth transistor having an emitter grounded and a collector and base connected to each other, a fifth transistor having an emitter area different from an emitter area of said fourth transistor and a base connected to said base of said fourth transistor, and a sixth resistor having one terminal connected to an emitter of said fifth transistor and the other terminal grounded.

6. A circuit according to claim 5, wherein said constant current circuit is a self-bias feedback circuit comprising said Widlar constant current circuit, a sixth transistor having a collector connected to said collector of said fourth transistor of said Widlar constant current circuit, and a seventh transistor having a collector connected to a collector of said fifth transistor of said Widlar constant current circuit, a base connected to said collector of said sixth transistor and a base of said sixth transistor, and an emitter area equal to an emitter area of said sixth transistor.

7. A circuit according to claim 5, wherein said collector and base of said fourth transistor constituting said constant current circuit are connected via a base current compensating transistor.

8. A circuit according to claim 6, wherein said collector and base of said fourth transistor constituting said constant current circuit are respectively connected to a base and emitter of a first base current compensating transistor having a collector connected to said external power supply terminal, and said collector and base of said seventh transistor are respectively connected to a base and emitter of a second base current compensating transistor having a collector grounded.

* * * * *